US006061944A

United States Patent [19]

Schroeder

[11] Patent Number: 6,061,944

[45] Date of Patent: May 16, 2000

[54] CENTERFIRE BOLT HEAD ASSEMBLY AND REPLACEMENT METHOD THEREWITH

[76] Inventor: Steve A. Schroeder, 1421 Thermal Ave., San Diego, Calif. 92154

[21] Appl. No.: 09/114,211

[22] Filed: Jul. 13, 1998

[51] Int. Cl.[7] ..... F41A 3/80

[52] U.S. Cl. ..... 42/16; 42/69.01

[58] Field of Search ..... 42/16, 69.02, 69.01, 42/25

[56] References Cited

U.S. PATENT DOCUMENTS

| | | | |
|---|---|---|---|
| 1,291,689 | 1/1919 | Sheppard | 89/128 |
| 2,173,576 | 9/1939 | Brewer | 42/16 |
| 3,330,061 | 7/1967 | Koon, Jr. | 42/16 |
| 3,456,375 | 7/1969 | Badali et al. | 42/16 |
| 3,631,620 | 1/1972 | Ohira | 42/16 |
| 3,696,542 | 10/1972 | Ekfeldt et al. | 434/308 |
| 3,745,683 | 7/1973 | Koon, Jr. | 42/16 |
| 3,745,686 | 7/1973 | Koon, Jr. | 42/16 |
| 3,849,925 | 11/1974 | Mayer | 42/75.02 |
| 4,069,608 | 1/1978 | Jurek | 42/49.02 |
| 4,169,329 | 10/1979 | Atchisson | 42/16 |
| 4,615,133 | 10/1986 | Center | 42/69.01 |
| 4,617,749 | 10/1986 | Jurek | 42/16 |
| 4,891,898 | 1/1990 | Houseman | 42/69.02 |
| 5,228,887 | 7/1993 | Mayer | 42/75.02 |
| 5,519,956 | 5/1996 | Howell | 42/70.08 |

*Primary Examiner*—Charles T. Jordan
*Assistant Examiner*—Denise J Buckley
*Attorney, Agent, or Firm*—Larson & Taylor

[57] ABSTRACT

A replacement centerfire bolt assembly for a rimfire rifle having a two-piece bolt with a detachable bolt head assembly and a method for modifying a bolt are disclosed. In accordance with the method, the bolt is first removed from the rifle, and then the rimfire bolt head assembly is removed from a remainder of the bolt. Next, a centerfire bolt head assembly is attached to the remainder of the bolt in place of the rimfire bolt head assembly. This centerfire bolt head assembly includes a bolt head having a central longitudinal axis, a cartridge end, a striker end, and an exterior size and configuration functionally identical to a size and configuration of a rimfire bolt head of the rimfire bolt head assembly. A bore is provided along the central longitudinal axis of the bolt head, with this bore including an enlarged recess adjacent the striker end. A one-piece centerfire firing pin is located in the bore of the bolt head, which firing pin is longer than the bore. This centerfire firing pin includes a head adjacent the striker end which is received in the recess. A spring is located in the recess and around the centerfire firing pin between the head and a bottom of the recess which urges the centerfire firing pin away from the cartridge end. After attachment of the centerfire bolt head assembly, the bolt is replaced in the rifle to complete the conversion process.

5 Claims, 1 Drawing Sheet

CENTERFIRE BOLT HEAD ASSEMBLY AND REPLACEMENT METHOD THEREWITH

FIELD OF THE INVENTION

The present invention relates generally to the conversion of a rimfire rifle to a centerfire rifle, and more particularly to a centerfire bolt head assembly and a method of replacing a rimfire bolt head assembly therewith.

BACKGROUND OF THE INVENTION

Rimfire rifles and the rimfire cartridges/ammunition which are used are very popular and widely used. However, rimfire cartridges are usable only once; i.e., rimfire cartridges cannot be reloaded. This presents no problem for very popular cartridges which are readily available commercially. However, for some rimfire rifles, such as any one of the REMINGTON model 591 and 592 rifles, the specified cartridges have not been manufactured for some time and thus cartridges for these rifles are increasingly harder to obtain and increasingly more expensive. Frequently, this results in the rifle no longer being of any real use.

SUMMARY OF THE INVENTION

In accordance with the present invention, a replacement centerfire bolt assembly for rifles such as those mentioned above, and a method for modifying such rimfire rifles having a two-piece bolt with a detachable bolt head assembly are provided. In accordance with the method, the bolt is first removed from the rifle, and then the rimfire bolt head assembly is removed from a remainder of the bolt. Next, a centerfire bolt head assembly is attached to the remainder of the bolt in place of the rimfire bolt head assembly.

The centerfire bolt head assembly preferably includes a bolt head having a central longitudinal axis, a cartridge end, a striker end, and an exterior size and configuration identical to a size and configuration of a rimfire bolt head of the rimfire bolt head assembly. A bore is provided along the central longitudinal axis of the bolt head, with this bore including an enlarged recess adjacent the striker end. A one-piece centerfire firing pin is located in the bore of the bolt head, which firing pin is longer than the bore. This centerfire firing pin includes a head adjacent the striker end which is received in the recess. A spring is located in the recess and around the centerfire firing pin between the head and a bottom of the recess which urges the centerfire firing pin away from the cartridge end. After attachment of the centerfire bolt head assembly, the bolt is replaced in the rifle to complete the conversion process.

In a preferred method for modifying a rimfire rifle, both a latch and an extractor from the rimfire bolt head assembly are removed after the step of removing the rimfire bolt head assembly from the remainder of the bolt. Thereafter, the latch and extractor are reattached to the centerfire bolt head assembly prior to the step of attaching of the centerfire bolt head assembly to the remainder of the bolt.

In the preferred method, the rifle is selected from one of a REMINGTON model 591, 592, 54X, or 58X rifle.

It is an advantage of the present invention that a rimfire rifle is easily and quickly converted to a centerfire rifle.

It is also an advantage of the present invention that with the conversion from rimfire to centerfire, re-loadable centerfire casings are then usable with the rifle so that problems with obtaining cartridges of the proper specifications or of different specifications are eliminated.

It is a further advantage of the present invention that the modification is a simple replacement of the bolt head assembly so that if desired the original rimfire bolt head assembly can be placed back in the bolt to return the rifle to its original manufactured condition and hence the collector's value of the rifle is not diminished.

Other features and advantages of the present invention are stated in or apparent from a detailed description of a presently preferred embodiment of the invention found hereinbelow.

DESCRIPTION OF THE PREFERRED EMBODIMENT

Figure 1:
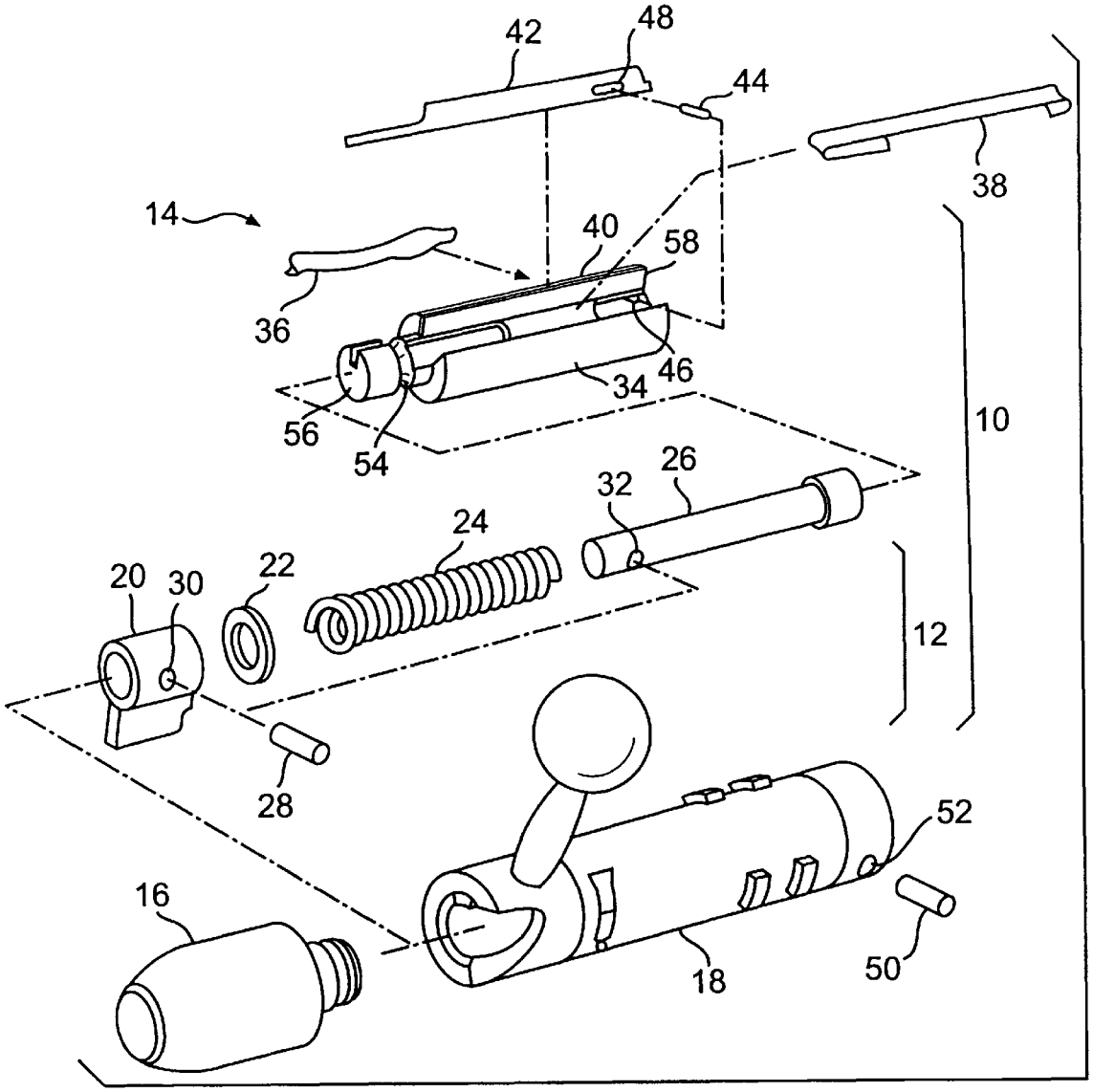
FIG. 1 PRIOR ART
FIG. 1 is an exploded perspective view of a prior art bolt including a rimfire bolt head assembly.

With reference now to the drawings in which like numerals represent like elements in the views, a prior art bolt 10 from a REMINGTON model 591, 592, 54X or 58X rifle (all of which have essentially the same bolt) is depicted in FIG. 1. Bolt 10 is two-piece bolt type having a bolt body assembly 12 and a detachable rimfire bolt head assembly 14. Bolt body assembly 12 includes a bolt plug 16, a bolt body 18, a cocking piece 20, striker washer 22, mainspring 24, and striker 26. A striker cross pin 28 in received first in a cross bore 30 provided in cocking piece 20 and then in a cross bore 32 provided in striker 26 as shown.

Rimfire bolt head assembly 14 includes a body head 34 to which a latch 36 and an extractor 38 are suitably associated in use. Body head 34 includes a longitudinal slot 40 in which a firing pin 42 is located for reciprocating movement. Firing pin 42 is held in slot 40 by a pin 44 which is received through a cross bore 46 provided in bolt head 34 and an elongate slot 48 (to allow movement) provided in firing pin 42. Rimfire bolt head assembly 14 is attached to bolt body assembly 12 by a bolt assembly pin 50 which passes through a cross bore 52 provided in bolt body 18 and into a circumferential groove 54 provided adjacent striker end 56. Firing pin 42 is slightly longer than bolt head 34, so that in operation firing pin 42 is struck by striker 26 to move firing pin longitudinally in slot 40 to strike a rim of a cartridge located immediately adjacent cartridge end 58 of bolt head 34.

As noted above, while bolt 10 is well suited for its use with rimfire cartridges, there may be occasions where the (usually) cheaper rimfire cartridges are not available (or readily available) or where cartridges of loads or other specifications desired are not otherwise available. In such situations, re-loadable centerfire cartridges may be available which can supply the needed cartridges or cartridge specification, but such re-loadable cartridges are not usable with bolt 10.

Figure 2:
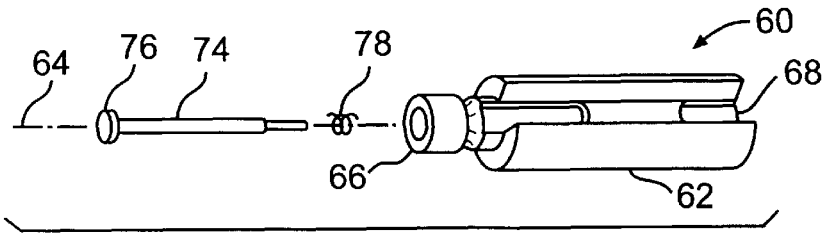
FIG. 2 is an exploded perspective view of a replacement centerfire bolt head assembly in accordance with the present invention which replaces the rimfire bolt head assembly depicted in FIG. 1.
Figure 3:
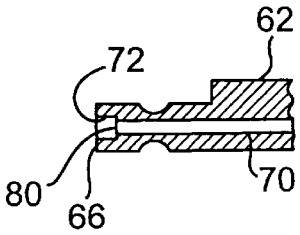
FIG. 3 is cross sectional elevation view of a striker portion of the bolt head depicted in FIG. 2.

With the present invention, a replacement centerfire bolt head assembly 60 as shown in FIGS. 2 and 3 is provided to replace rimfire bolt head assembly 14 and hence to provide the rifle with the capability to use centerfire cartridges. Centerfire bolt head assembly 60 includes a bolt head 62 which has an exterior size and configuration substantially identical to bolt head 34 in order to operate in the same manner with latch 36 and extractor 38 (and the associated receiver assembly of the rifle not shown) and to provide total base support for the cartridge case head of any centerfire cartridge used. Bolt head 62 is made of the same, or equivalent, material as bolt head 34 is made of. Obviously centerfire bolt head 62 does not have the elements associated with the rimfire firing pin—namely slot 40, rim fire firing pin 42, pin 44 and cross bore 46.

Centerfire bolt head assembly 62 includes a central longitudinal axis 64 between a striker end 66 and a cartridge end 68. A bore 70 is provided along axis 64 from striker end 66 to cartridge end 68. Bore 70 includes a recess 72 at striker end 66. Received in bore 70 is a one-piece solid centerfire firing pin 74 made of the same, or equivalent, material as firing pin 42. Firing pin 74 includes a head 76 adjacent striker end 66 which is sized to be received in recess 72. A small spring 78 is located in recess 72 about firing pin 74 between head 76 and a bottom 80 of recess 72. Spring 78 urges firing pin 74 slightly away from cartridge end 68 in order to help prevent accidental firing of a cartridge when bolt 10 is in place in the rifle and a cartridge is loaded in the rifle.

The method of modifying a rimfire rifle having a two-piece bolt 10 with a detachable rimfire bolt head assembly 14 is as follows. Initially, it will be appreciated that bolt 10 must be removed from the rifle, in a manner well known in the art. Once removed, rimfire bolt head assembly 14 is detached from a remainder of bolt 10 (which in this embodiment is bolt body assembly 12) by pulling pin 50 in cross bore 52 outwards and out of engagement with groove 54. Latch 36 and extractor 38 are then separated from rimfire bolt head 34, and immediately united with bolt head 62 of centerfire bolt head assembly 60. Centerfire bolt head assembly 60 is next attached to the remainder (bolt body assembly 12) of bolt 10 using pin 50. Finally, bolt 10, with centerfire bolt head assembly 60 provided in place of rimfire bolt head assembly 14, is then put back in the rifle to complete the conversion of the rifle from the use of rimfire cartridges to re-loadable centerfire cartridges.

If desired, an optional wider rimless case extractor (not shown)can be provided for use with rimless cartridges. Also, go/no-go headspace gauges (not shown) can be provided to ensure that proper headspacing of the bolt is made and that the rifle is within tolerances to be safe to fire.

While the present invention has been described with respect to an exemplary embodiment thereof, it will be understood by those of ordinary skill in the art that variations and modifications can be effected within the scope and spirit of the invention.

I claim:

1. A method for modifying a rimfire rifle having a two-piece bolt with a detachable rimfire bolt head assembly comprising the steps of:

removing the bolt from the rifle;

removing the rimfire bolt head assembly from a remainder of the bolt;

attaching a centerfire bolt head assembly to the remainder of the bolt in place of the rimfire bolt head assembly, the centerfire bolt head assembly including a bolt head having a central longitudinal axis, a cartridge end, a striker end, and an exterior size and configuration identical to a size and configuration of a rimfire bolt head of the rimfire bolt head assembly, a bore provided along the central longitudinal axis of the bolt head, the bore including an enlarged recess adjacent the striker end, a one-piece solid centerfire firing pin located in the bore of the bolt head which is longer than the bore, the centerfire firing pin including a head adjacent the striker end which is received in the recess, and a spring located in the recess and around the centerfire firing pin between the head and a bottom of the recess; and replacing the bolt in the rifle.

2. A method for modifying a rimfire rifle as claimed in claim 1, and further including the steps of:

removing both a latch and an extractor from the rimfire bolt head assembly after the step of removing the rimfire bolt head assembly from the remainder of the bolt; and attaching the latch and extractor to the centerfire bolt head assembly prior to the step of attaching of the centerfire bolt head assembly to the remainder of the bolt.

3. A method for modifying a rimfire rifle as claimed in claim 2, wherein the rifle is selected from one of a REMINGTON model 591, 592, 54X, or 58X rifle.

4. A replacement centerfire bolt head assembly which is adapted to replace a detachable rimfire bolt head assembly in a two-piece bolt, said replacement centerfire bolt head assembly comprising:

a bolt head having a central longitudinal axis, a cartridge end, a striker end, and an exterior size and configuration adapted to be identical to a size and configuration of a rimfire bolt head of the rimfire bolt assembly;

a bore provided along the central longitudinal axis of said bolt head;

a centerfire firing pin located in said bore which is longer than said bore, said centerfire firing pin including a head adjacent said striker end which is received in said recess.

5. A replacement centerfire bolt head assembly as claimed in claim 4:

wherein said bore includes an enlarged recess adjacent said striker end;

wherein said centerfire firing pin is made in one solid piece and includes a head adjacent said striker end which is received in said recess; and further including a spring located in said recess and around said centerfire firing pin between said head and a bottom of said recess which urges said centerfire firing pin away from said cartridge end.

* * * * *